US007896621B2

(12) United States Patent
Park et al.

(10) Patent No.: US 7,896,621 B2
(45) Date of Patent: Mar. 1, 2011

(54) MICRO PUMP

(75) Inventors: Tae-sik Park, Suwon-si (KR); Young-il Kim, Suwon-si (KR); Jung-ho Kang, Suwon-si (KR); Moon-chul Lee, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 441 days.

(21) Appl. No.: 11/266,903

(22) Filed: Nov. 4, 2005

(65) Prior Publication Data

US 2011/0020140 A1 Jan. 27, 2011

(30) Foreign Application Priority Data

Dec. 7, 2004 (KR) ..... 10-2004-0102198

(51) Int. Cl.
*F04B 19/24* (2006.01)

(52) U.S. Cl. ..... 417/52; 417/207; 417/209; 251/11; 251/129.01

(58) Field of Classification Search ..... 417/52, 417/207, 208, 209; 251/11, 129.01
See application file for complete search history.

(56) References Cited

U.S. PATENT DOCUMENTS

| | | | | |
|---|---|---|---|---|
| 4,314,008 | A * | 2/1982 | Blake | 429/8 |
| 5,375,979 | A * | 12/1994 | Trah | 417/52 |
| 6,007,302 | A * | 12/1999 | Welle | 417/52 |
| 6,071,081 | A * | 6/2000 | Shiraishi | 417/52 |
| 6,531,417 | B2 | 3/2003 | Choi et al. | 438/800 |
| 2003/0010948 | A1 * | 1/2003 | Horiuchi et al. | 251/11 |
| 2004/0033146 | A1 | 2/2004 | Dai et al. | 417/413.2 |
| 2006/0078434 | A1 * | 4/2006 | Kim et al. | 417/51 |

FOREIGN PATENT DOCUMENTS

| | | | |
|---|---|---|---|
| JP | 29-8625 | | 5/1952 |
| JP | 58-167799 | | 11/1983 |
| JP | 07-293424 | | 11/1995 |
| JP | 2003-211701 | * | 7/2003 |
| JP | 2004036471 | | 2/2004 |

OTHER PUBLICATIONS

D.D.L. Wijngaards et al. "Design and Fabrication of on-chip integrated polySiGe and polySi Peltier Devices," 2000, Sensors and Actuators 85, pp. 316-323.*

Japanese Office Action corresponding with Japanese Patent Application No. 2005-353509; Dated Jul. 8, 2008.

* cited by examiner

*Primary Examiner* — Devon C. Kramer
*Assistant Examiner* — Philip Stimpert
(74) *Attorney, Agent, or Firm* — Cantor Colburn LLP

(57) ABSTRACT

Provided is a micro pump having a simple structure. The micro pump includes a pump chamber including inflow and outflow passages through which a drive fluid flows, a first valve configured to open or close the inflow passage, a second valve configured to open or close the outflow passage, and a pump chamber heating and cooling unit configured to heat or cool the pump chamber.

4 Claims, 10 Drawing Sheets

MICRO PUMP

This application claims priority to Korean Patent Application No. 2004-102198, filed on Dec. 7, 2004, in the Korean Intellectual Property Office, and all the benefits accruing therefrom under 35 U.S.C. §119, the disclosure of which is incorporated herein by reference in its entirety.

BACKGROUND OF THE INVENTION

1. Field of the Invention

The present invention relates to a compact fluid system, and more particularly, to a micro pump adoptable to a compact fluid system.

2. Description of the Related Art

The recent rapid progress of micro machining techniques enables the development of a Micro-Electro Mechanical System (MEMS) having various functions. Such an MEMS is widely used in the fields of genetic engineering, medical diagnoses, drug discovery, and the like. In particular, the performance of all necessary processes including chemical reaction and analysis on a chip, a so-called Lab On a Chip (LOC), is introduced. Thus, an MEMS is more actively studied.

A fluid such as a sample, a reagent, or the like, must flow in units of micro-liters to drive such a chip or a compact fluid system. Thus, a drive source is required to flow such a fluid. A micro pump is one such example of a drive source.

The micro pump may be a bubble pump, a membrane pump, a rotary pump, or the like. The bubble pump heats a chamber to generate bubbles in a fluid filling the chamber and flows the fluid using a pressure of the bubbles. The membrane pump contracts and compresses the chamber using an electrostatic force to flow the working fluid. The rotary pump rotates a rotator, having a plurality of blades on a circumferential surface thereof, to flow a fluid in and out therefrom.

However, each of the above described drive sources have certain disadvantages associated therewith. For example, a bubble pump has a complicated structure and requires a long time to heat a drive fluid for flowing a working fluid. The membrane pump also has a complicated structure and consumes a large amount of energy to generate the electrostatic force. The rotary pump has a complicated structure and a low reliability, and is easily not assembled. It is therefore difficult for the bubble, membrane, and rotary pumps to control a minute flow amount of a working fluid.

SUMMARY OF THE INVENTION

Accordingly, the present general inventive concept has been made to solve the above-mentioned and other problems, and an aspect of the present general inventive concept is to provide a micro pump having a simple structure.

Another aspect of the present general inventive concept is to provide a micro pump capable of reducing energy consumption.

Another aspect of the present general inventive concept is to provide a micro pump capable of controlling a minute flow amount of a working fluid.

According to an aspect of the present invention, there is provided a micro pump including: a pump chamber including inflow and outflow passages through which a drive fluid flows; a first valve selectively opening and/or closing the inflow passage; a second valve selectively opening and/or closing the outflow passage; and a pump chamber heating and cooling unit heating and/or cooling the pump chamber.

The pump chamber heating and cooling unit may include: a pump chamber thermoelectric module coupled to the pump chamber and including sides selectively heated and cooled according to a direction of current supplied thereto; and a pump chamber power supplying unit applying power to the pump chamber thermoelectric module.

According to an aspect of the present invention, the first and second valves may be passive valves allowing a flow of a fluid only in one direction.

According to another aspect of the present invention, the first valve may include: a first valve chamber contracted or expanded so as to open or close the inflow passage; and a first valve chamber thermoelectric module coupled to the first valve chamber so as to contract or expand the first valve chamber. A side of the first valve chamber facing the inflow passage may be formed of a contractible and expandable thin film. The second valve may include: a second valve chamber contracted or expanded so as to open and/or close the outflow passage; and a second valve chamber thermoelectric module coupled to the second valve chamber so as to contract or expand the second valve chamber. A side of the second valve chamber facing the outflow passage may be formed of a contractible and expandable thin film.

According to another aspect of the present invention, there is provided a micro pump including: a pump chamber including inflow and outflow passages through which a drive fluid flows; a pump chamber thermoelectric module of a vertical type attached to the pump chamber; a first valve chamber to which a first valve thermoelectric module of a vertical type is attached and which is contracted and expanded by the first valve thermoelectric module so as to selectively open and/or close the inflow passage; and a second valve chamber to which a second valve thermoelectric module of vertical type is attached and which is contracted and expanded by the second valve thermoelectric module so as to selectively open and/or close the outflow passage.

According to still another aspect of the present invention, there is provided a micro pump including: a pump chamber including inflow and outflow passages through which a drive fluid flows; a first valve chamber to which a vertical type thermoelectric module is attached and which is selectively contracted or expanded so as to open or close the inflow passage; a second valve chamber contracted and expanded so as to open or close the outflow passage; and a horizontal type thermoelectric module selectively heating or cooling the pump chamber and the second valve chamber. The horizontal type thermoelectric module may include: a first plate attached to the pump chamber; a second plate attached to the second valve chamber; and a plurality of semiconductors interposed between the first and second plates and electrically connected to one another. Lower surfaces of the first and second valve chambers may be formed of contractible and expandable thin films which are contracted and expanded so as to open or close the inflow and outflow passages.

According to yet another aspect of the present invention, there is provided a micro pump including: a pump chamber including inflow and outflow passages; a first valve chamber selectively opening and/or closing the inflow passage; a second valve chamber selectively opening and/or closing the outflow passage; and a horizontal type thermoelectric module heating or cooling the pump chamber and the first and second valve chambers. The horizontal type thermoelectric module may include: a first plate attached to the pump chamber and the first valve; a second plate attached to the second valve chamber; and a plurality of semiconductors interposed between the first and second plates and electrically connected to one another.

BRIEF DESCRIPTION OF THE DRAWINGS

The above aspects and features of the present invention will be more apparent by describing certain embodiments of the present invention with reference to the accompanying drawings, in which.

DETAILED DESCRIPTION OF THE PREFERRED EMBODIMENTS

Figure 1:
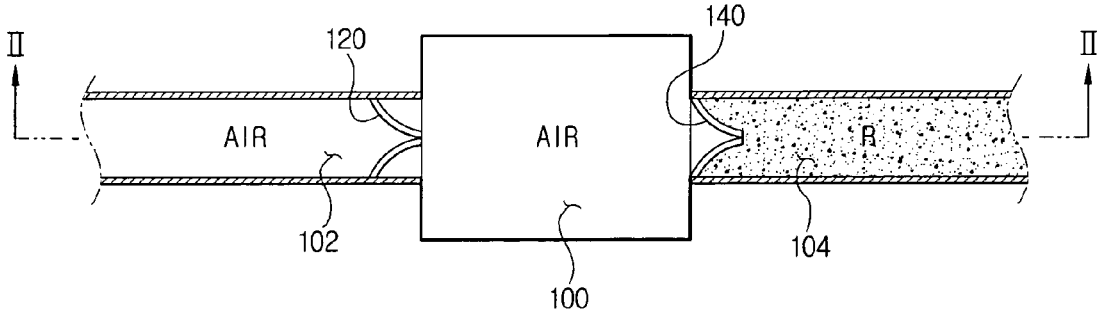
FIG. 1 is a schematic plan view of a micro pump according to an embodiment of the present invention.

Certain embodiments of the present invention will be described in greater detail with reference to the accompanying drawings.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. It will be also understood that when an element is referred to as being "on" another element, it can be directly on the other element or intervening elements may be present therebetween.

In the following description, the same drawing reference numerals are used for like elements in different drawings, for ease of illustration. Specific details included in the description, such as detailed construction and elements, are provided solely to assist in a comprehensive understanding of the invention. Thus, it should be appreciated that the present invention can be carried out without such specific details. Also, certain well-known functions or constructions are not described in detail herein, since they would obscure the invention in unnecessary detail.

Hereinafter, a micro pump according to embodiments of the present invention will be described in detail with reference to the attached drawings.

Figure 2A:
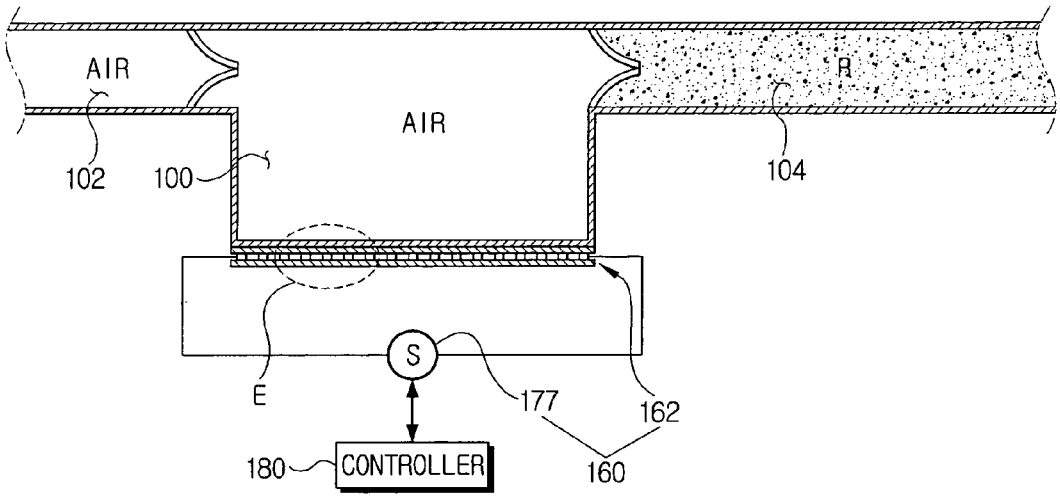
FIG. 2A is a cross-sectional view taken along line II-II shown in FIG. 1.

Referring to FIGS. 1 and 2, a micro pump according to an embodiment of the present invention includes a pump chamber 100, first and second valves 120 and 140, a heating and cooling unit 160, and a controller 180. Inflow and outflow passages 102 and 104 through which a drive fluid flows in and out are formed at the pump chamber 100. The first valve 120 selectively opens and/or closes the inflow passage 102, and the second valve 140 selectively opens and/or closes the outflow passage 104. The heating and cooling unit 160 heats or cools the pump chamber 100.

The pump chamber 100 has a space which is formed from a barrier rib that is not contracted and which is filled with a drive fluid for driving a working fluid. The drive fluid may be a gas such as air, a volume of which greatly varies depending on the temperature thereof. Alternatively, the drive fluid may be a liquid that generates bubbles and that is not melted with a working fluid R. In the present embodiment, air is illustrated as an example of the drive fluid. The inflow passage 102 through which air flows in is formed on the left side of the pump chamber 100 and is exposed to the air so that an atmospheric pressure is formed. However, in a case where the drive fluid is an additional gas or liquid other than air, the inflow passage 102 is connected to a reservoir (not shown) storing the drive fluid. The outflow passage 104 is formed on the right side of the pump chamber 100, and is filled with the working fluid R, such as a sample to be analyzed by a biochip or a reagent for analyzing the sample.

In the present embodiment, the first valve 120 is a passive valve. Thus, the first valve 120 opens the inflow passage 102 only when the atmospheric pressure is greater than the pressure of the pump chamber 100.

Like the first valve 120, the second valve 140 is a passive valve that, only when the pressure of the pump chamber 100 is greater than the pressure of the outflow passage 104, opens the outflow passage 104.

The heating and cooling unit 160 includes a thermoelectric module 162 and a power supplying unit 177 supplying current to the thermoelectric module 162.

Figure 2B:
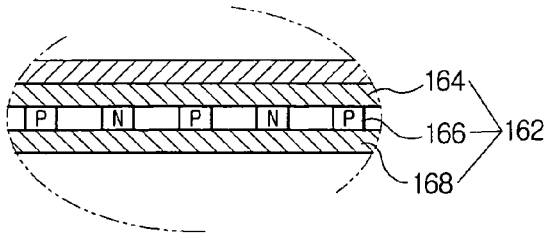
FIG. 2B is an enlarged view of portion E shown in FIG. 2A.

As particularly shown in FIG. 2B, the thermoelectric module 162 includes a first plate 164 which is fixed on a lower surface of the pump chamber 100 by a fixing means such as an adhesive or the like. The thermoelectric module 162 may be a vertical type thermoelectric module contacting the lower surface of the pump chamber 100. The thermoelectric module 162 also includes a second plate 168 which faces the first plate 164, and a semiconductor layer 166 which is interposed between the first and second plates 164 and 168. The semiconductor layer 166 is connected to the power supplying unit 177 so as to be supplied with current, and selectively heats or cools the first and second plates 164 and 168 depending on the direction of the supplied current through Peltier effect heating/cooling of the thermoelectric module 162. For example, if power is applied to the semiconductor layer 166, the semiconductor layer 166 absorbs heat from the first plate 164 to cool the first plate 164 and transmits the heat to the second plate 168 so as to heat the second plate 168. Conversely, if the direction of the current supplied by the power supplying unit 177 is reversed, then the semiconductor layer 166 absorbs heat from the second plate 168 to cool the second plate 168 and transmits the heat to the first plate 164 so as to heat the first plate 164. Peltier effect devices, such as the thermoelectric module 162, are well known devices and are thus not described in further detail hereinafter.

The controller 180 is connected to the power supplying unit 177 to communicate a signal to the power supplying unit 177 so as to control the direction of the current supplied to the thermoelectric module 162.

The operation of the micro pump shown in FIG. 1 will now be described with reference to FIGS. 3A and 3B.

Figure 3A:
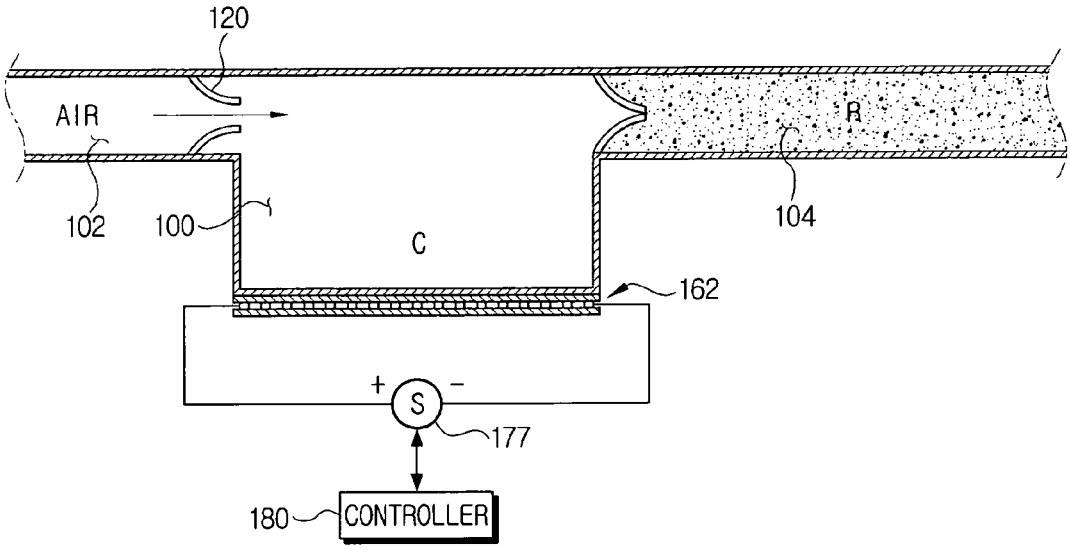
FIGS. 3A and 3B are cross-sectional views illustrating the operation of the micro pump shown in FIGS. 1 and 2A.

Referring to FIG. 3A, the controller 180 controls the power supplying unit 177 to supply current in a first direction to the thermoelectric module 162. As a result, the pump chamber 100 is then cooled C, causing the air present in the pump chamber 100 to be condensed. Thus, the pressure of the pump chamber 100 becomes lower than the atmospheric pressure of the inflow passage 102. As a result, the first valve 120 is opened, and air flows into the pump chamber 100.

Figure 3B:
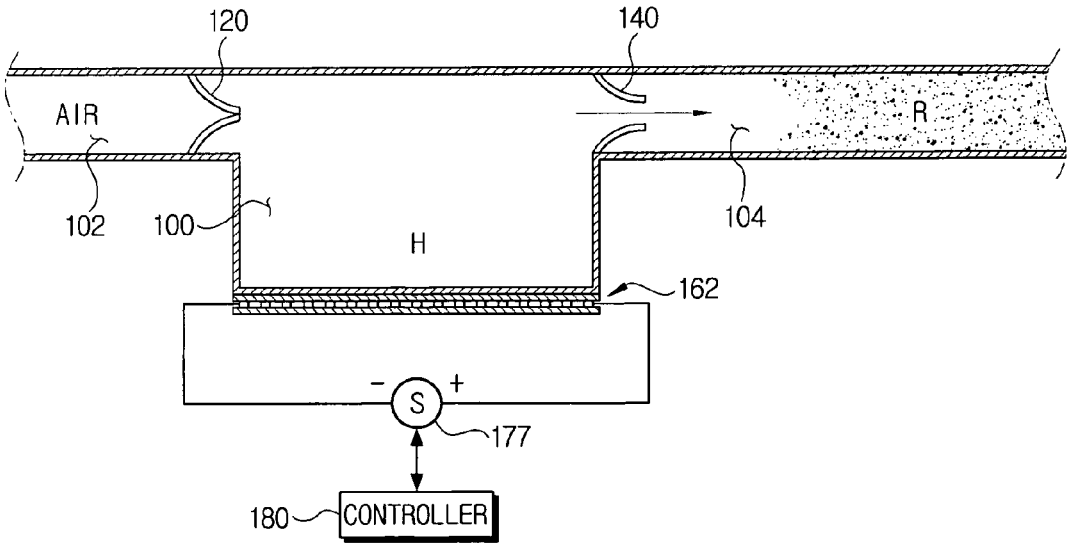

Referring to FIG. 3B, the controller 180 changes the direction of the current supplied to the thermoelectric module 162. The pump chamber 100 is then heated H, causing the air in the pump chamber 100 to be expanded, thereby increasing the pressure of the pump chamber 100. As the pressure of the pump chamber 100 becomes greater than the atmospheric pressure, the first valve 120 closes, preventing the continued flow of air from the inflow passage 102 to the pump chamber 100. As the pressure of the pump chamber 100 continues to increase and exceeds the pressure of the outflow passage 104, the second valve 140 is opened. The air in the pump chamber 100 then moves toward the outflow passage 104 to flow the working fluid R.

The above-described process may be repeatedly performed so as to flow a desired amount of working fluid to a location that utilizes the working fluid.

A micro pump according to another embodiment of the present invention will be described with reference to FIGS. 4 through 6.

Figure 4:
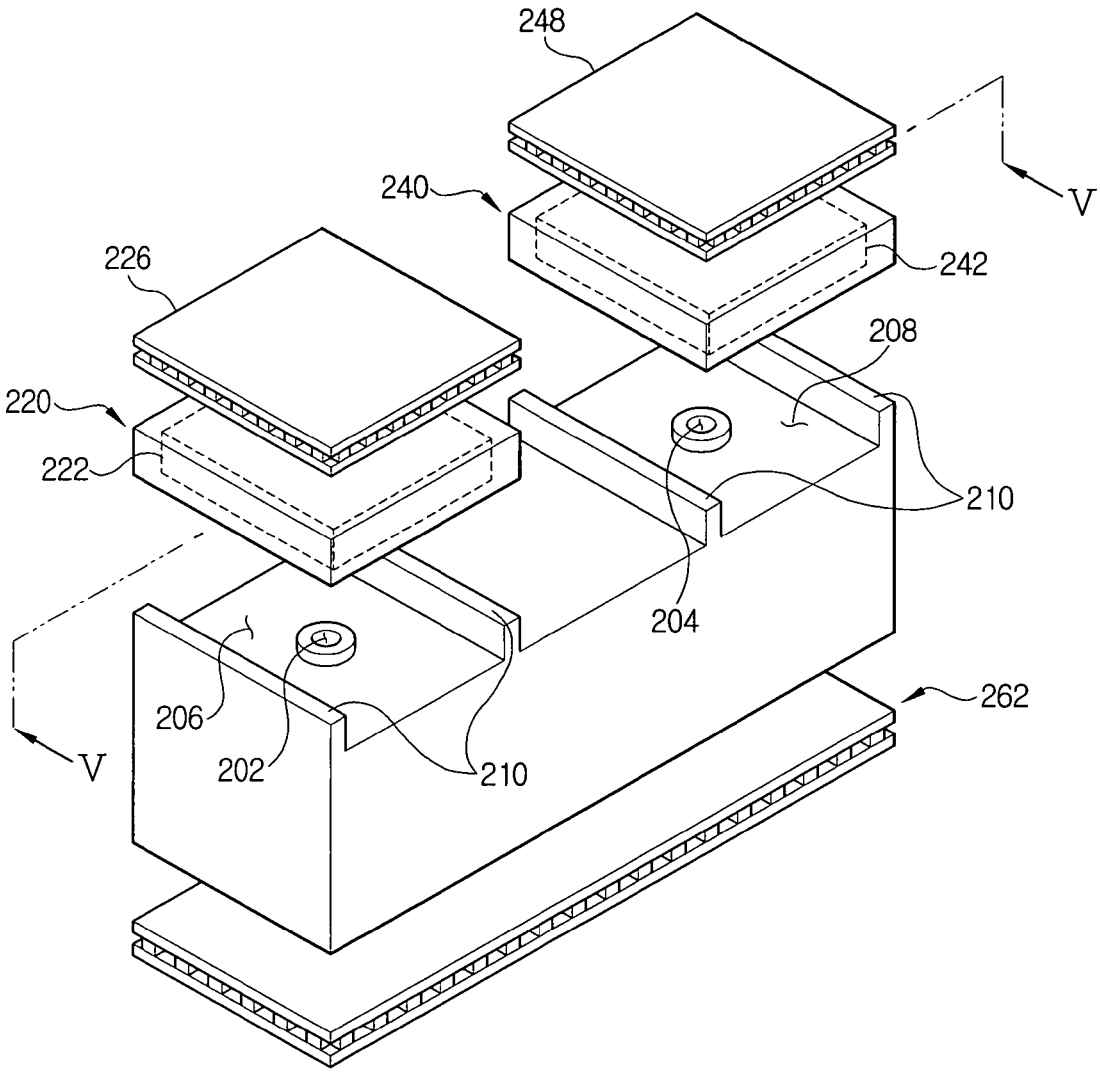
FIG. 4 is a schematic exploded perspective view of a micro pump according to another embodiment of the present invention.
Figure 5:
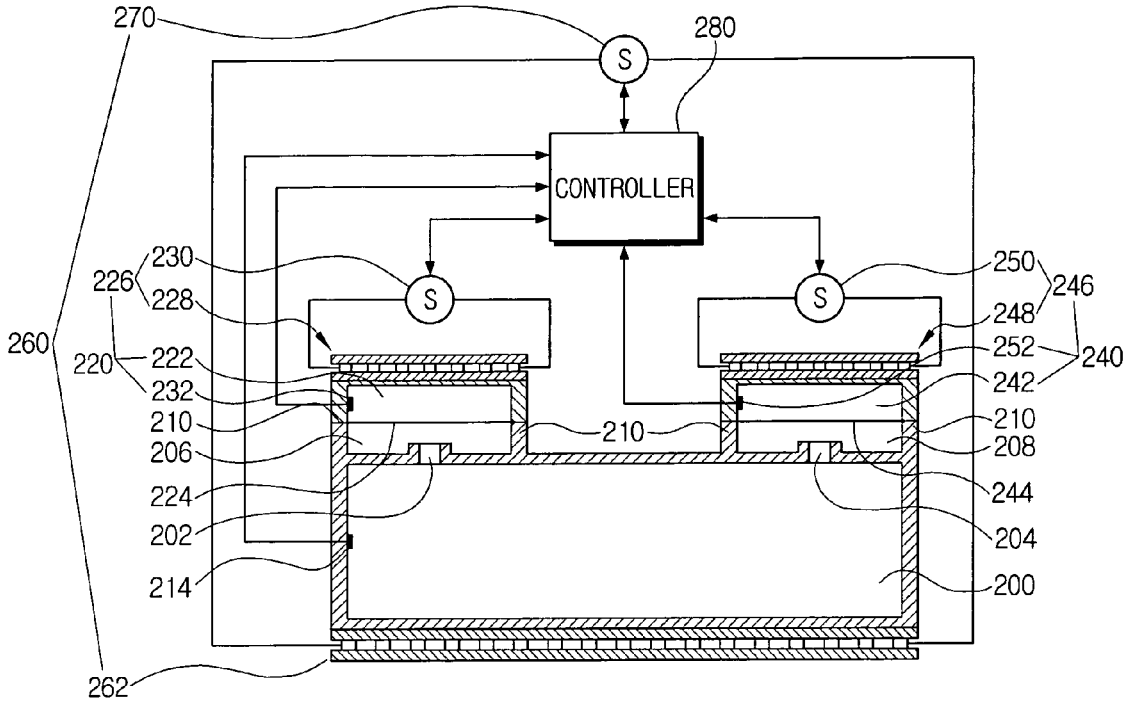
FIG. 5 is a cross-sectional view taken along line V-V shown in FIG. 4.

Referring to FIGS. 4 and 5, in contrast the micro pump according to the previous embodiment, the micro pump according to the present embodiment has a structure in which first and second valves 220 and 240 may be separately controlled. The micro pump includes a pump chamber 200, the first and second valves 220 and 240, a heating and cooling unit 260, and a controller 280. Inflow and outflow passages 202 and 204 are formed at the pump chamber 200. The first valve 220 selectively opens and/or closes the inflow passage 202, while the second valve 240 selectively opens and/or closes the outflow passage 204. The heating and cooling unit 260 heats or cools the pump chamber 200.

Two supporting parts 210 protrude from each of both sides of an upper surface of the pump chamber 200 so as to fix and support the first and second valves 220 and 240. Also, first and second channels 206 and 208 are provided so as to form steps with the supporting parts 210, and the inflow and outflow passages 202 and 204 are respectively formed at the first and second channels 206 and 208 so as to be connected to the pump chamber 200. The first channel 206 is a passage through which air as a drive fluid flows and which is opened to the atmosphere so as to absorb air. The second channel 208 is a channel through which a working fluid flows and which is connected to a location (not shown) utilizing the working fluid. A pump chamber sensor 214 is installed within the pump chamber 200 to sense physical information of the pump chamber 200. The physical information sensed by the sensor 214 may be, for example, a parameter such as temperature, pressure, current supplying time, or the like, of the pump chamber 200.

The first valve 220 includes a first valve chamber 222, a first valve heating and cooling unit 226 for heating or cooling the first valve chamber 222, and a first valve sensor 232 for sensing physical information of the first valve chamber 222.

The first valve chamber 222 is fixed to the supporting parts 210 by a fixing means such as an adhesive or the like. A lower surface of the first valve chamber 222 is formed of a contractible and expandable thin film 224 so as to be contracted and expanded, depending on the pressure of the first valve chamber 222. The inflow passage 202 is selectively opened or closed by contracting or expanding the thin film 224.

The first valve heating and cooling unit 226 includes a thermoelectric module 228 of a vertical type and a power supplying unit 230 supplying a current to the thermoelectric module 228. In contrast to a vertical type thermoelectric module, the opposing plates of a horizontal type thermoelectric module as discussed herein lie in substantially the same plane. The thermoelectric module 228 is attached to an upper surface of the first valve chamber 222 by a fixing means, such as an adhesive or the like, so as to selectively heat or cool the first valve chamber 222.

The first valve sensor 232 is installed inside the first valve chamber 222 to sense physical information of the first valve chamber 222.

The second valve 240 is configured the same as the first valve 220, in terms of structure and operation principle. In other words, like the first valve 220, the second valve 240 includes a second valve chamber 242, a second valve heating and cooling unit 246, and a second valve sensor 252. The second valve heating and cooling unit 246 includes a thermoelectric module 248 of vertical type and a power supplying unit 250.

The pump chamber heating and cooling unit 260 includes a thermoelectric module 262 fixed on the lower surface of the pump chamber 200 and a power supplying unit 270 supplying power to the thermoelectric module 262.

The controller 280 is connected to each of the power supplying units 230, 250, and 270, as well as to the pump chamber sensor 214, the first valve sensor 232, and the second valve sensor 252 so as to communicate signals with them. In particular, the controller 280 also controls the power supplying units 230, 250, and 270 so as to be turned on and/or off, along with and directions of currents supplied to the thermoelectric modules 228, 248, and 262, depending on the physical information sensed by the pump chamber sensor 214, the first valve sensor 232, and the second valve sensor 252.

The operation of the micro pump shown in FIG. 4 will now be described in detail with reference to FIGS. 6A and 6B.

Figure 6A:
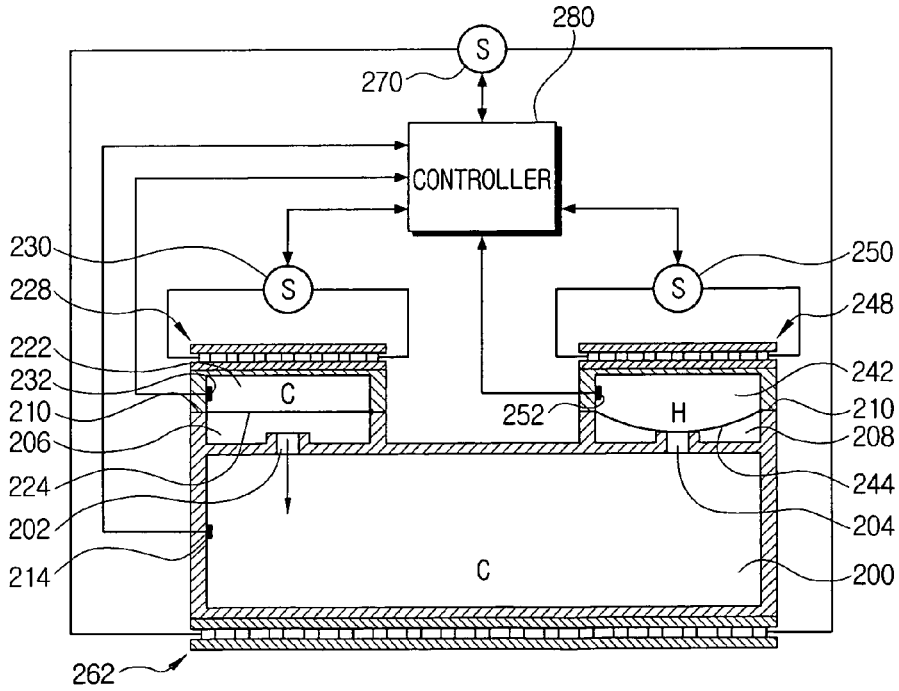
FIGS. 6A and 6B are cross-sectional views illustrating the operation of the micro pump shown in FIGS. 4 and 5.

Referring to FIG. 6A, the controller 280 controls the power supplying units 230, 250, and 270 to supply currents to the thermoelectric modules 228, 248, and 262, respectively. Due to the polarity of the respective currents applied to the thermoelectric modules 228, 248, and 262, the pump chamber 200 and the first valve chamber 222 are cooled C, while the second valve chamber 242 is heated H. Since the first valve chamber 222 is cooled C, the thin film 224 of the lower surface of the first valve chamber 222 is contracted. Thus, the outflow passage 204 is opened. On the other hand, the second valve chamber 242 is heated H, and air filling the second valve chamber 242 is expanded. Thus, a thin film 244 of a lower surface of the second valve chamber 242 is expanded. The expansion of the thin film 244 causes the outflow passage 204 to be blocked (closed). Also, since the pump chamber 200 is cooled C, the air in the pump chamber 200 is condensed. Thus, the pressure of the pump chamber 200 is lower than the atmospheric pressure. Air then sequentially passes through the first channel 206 and the inflow passage 202 (being open) so as to flow into the pump chamber 200.

Figure 6B:
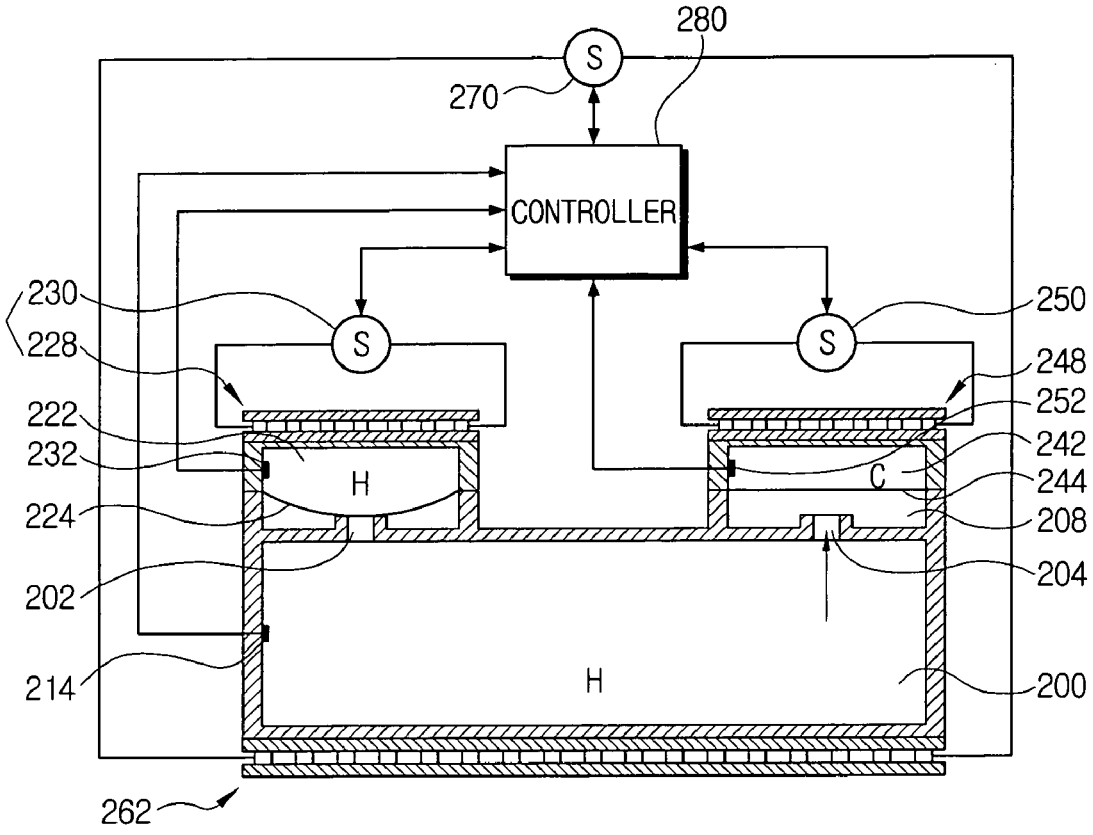

Referring to FIG. 6B, the controller 280 controls the power supplying units 230, 250, and 270 in a manner so as to change the directions of the currents supplied to the thermoelectric modules 228, 248, and 262. The pump chamber 200 and the first valve chamber 222 are then heated H, while the second valve chamber 242 is cooled C. Thus, the thin film 224 of the first valve chamber 222 is expanded to close the inflow passage 202, and the thin film 244 of the second valve chamber 242 is contracted to open the outflow passage 204. The air in the pump chamber 200 is heated H to increase the pressure of the pump chamber 200. The increased pressure causes the air to flow out through the outflow passage 204 and the second channel 208, with the outflowing air moving the working fluid to a place utilizing the same.

The pump chamber sensor 214, the first valve sensor 232, and the second valve sensor 252 sense the physical information of the pump chamber 200, the first valve chamber 222, and the second valve chamber 242, respectively, and transmit the physical information to the controller 280. The controller 280 then controls the power supplying units 230, 250, and 270 according to the physical information to control times required for supplying the currents, intensities of the supplied currents, and the like. Degrees of opening the inflow and outflow passages 202 and 204 may be controlled in this manner. For example, specific amounts of air flowing into the pump chamber 200, flowing out from the pump chamber 200, and heating in the pump chamber 200 may be individually controlled. A flow amount of the working fluid, a pressure of the working fluid, and the like can also be controlled in this manner. Because a minute flow amount of the working fluid can be controlled, a more precise fluid system is achieved.

A micro pump according to still another embodiment of the present invention will now be described in detail with reference to FIGS. 7 through 9B. The micro pump according to the present embodiment is different from the micro pump according to the previous embodiment in that a thermoelectric module 362 of a horizontal type is used to heat and cool a second valve chamber 342 and a pump chamber 300. Thus, only parts of a structure of the micro pump according to the present invention different from those of the structure of the micro pump according to the previous embodiment will be described in detail.

Figure 7:
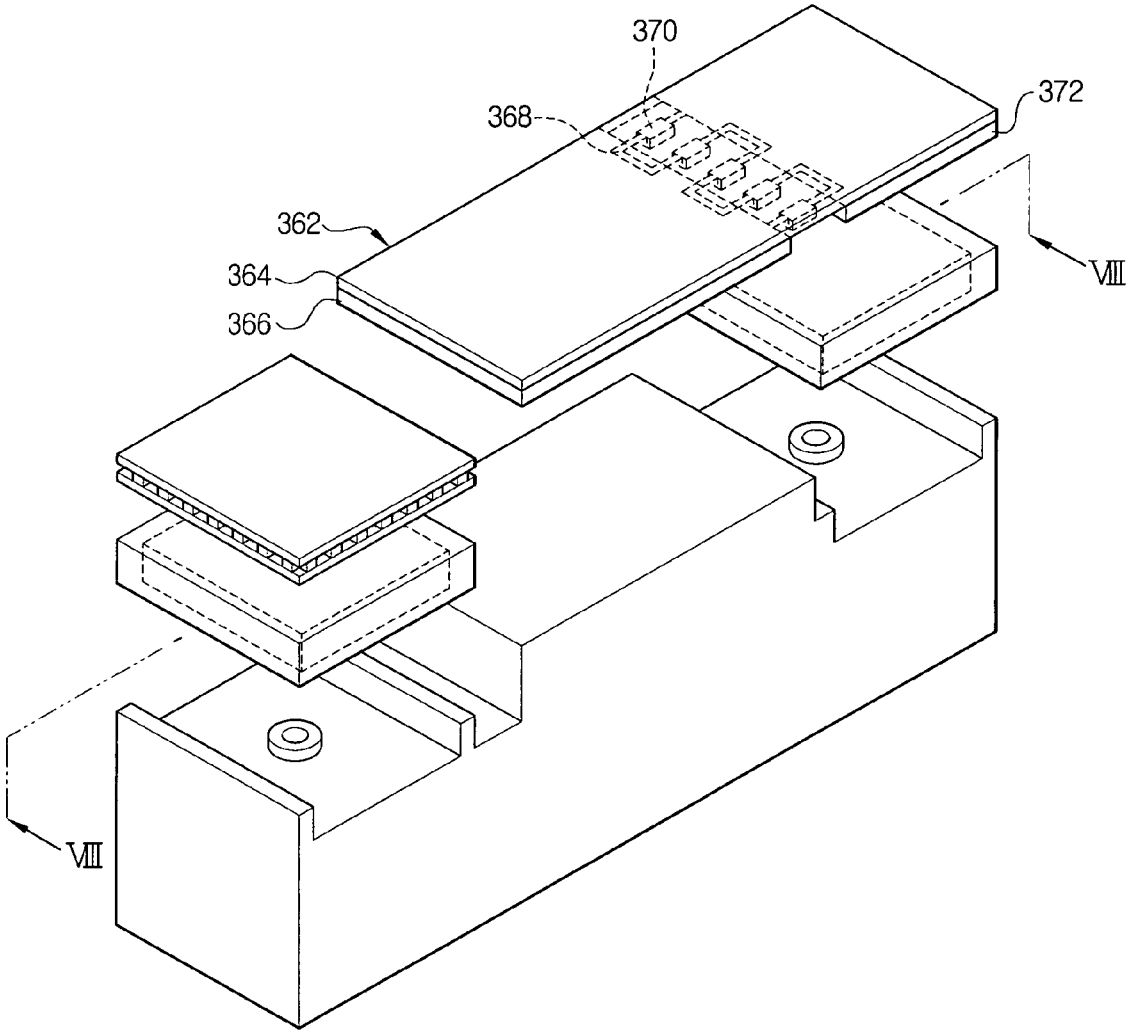
FIG. 7 is a schematic exploded perspective view of a micro pump according to still another embodiment of the present invention.
Figure 8:
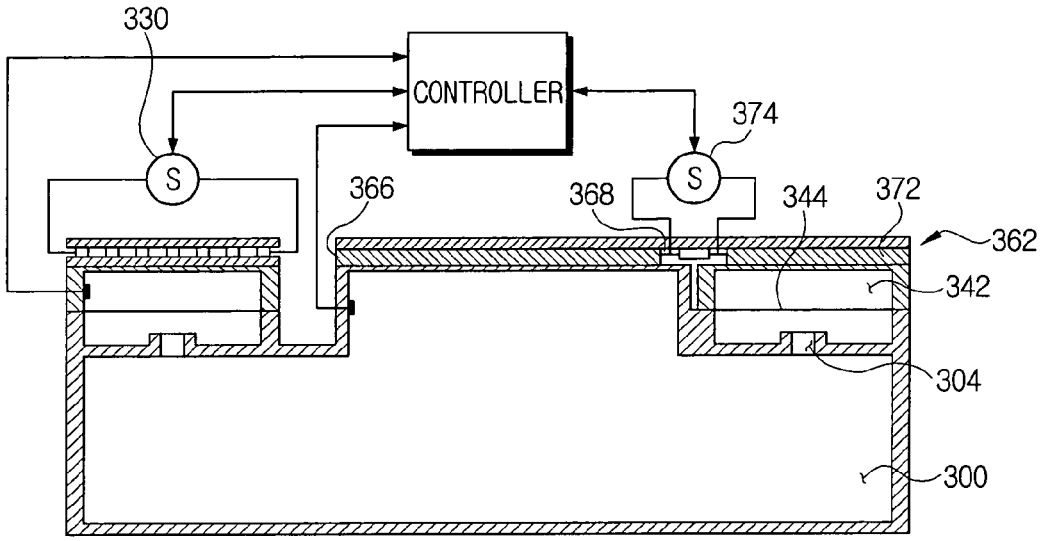
FIG. 8 is a cross-sectional view taken along line VIII-VIII shown in FIG. 7.

Referring to FIGS. 7 and 8, the horizontal type thermoelectric module 362 is attached to the pump chamber 300 and an upper surface of the second valve chamber 342 by a fixing means such as an adhesive or the like. The thermoelectric module 362 of horizontal type includes a frame 364, first and second plates 366 and 372 respectively formed at both sides of the frame 364, a plurality of semiconductors 370 installed on the frame 364 so as to be positioned between the first and second plates 366 and 372, and a conductor 368 connected to a power supplying unit 374 and connecting the plurality of semiconductors 370.

The first plate 366 is positioned on an upper surface of the pump chamber 300, and the second plate 372 is attached to the upper surface of the second valve chamber 342. Thus, when the power supplying unit 374 supplies current to the conductor 368, one of the first and second plates 366 and 372 is heated, and the other is cooled. As a result, when power is applied to the horizontal type thermoelectric module 362, one of the pump chamber 300 and the second valve chamber 342 is heated while the other is cooled. Again, the principles of operation of the Peltier effect type thermoelectric module 362 are well known in the art, and thus the detailed description thereof is omitted. As the remaining structural elements of the structure of the micro pump according to the present embodiment are the same as those in the previous embodiment of FIGS. 4-6, the detailed description thereof is not repeated.

The operation of the micro pump shown in FIG. 7 will be described in detail with reference to FIGS. 9A and 9B.

Figure 9A:
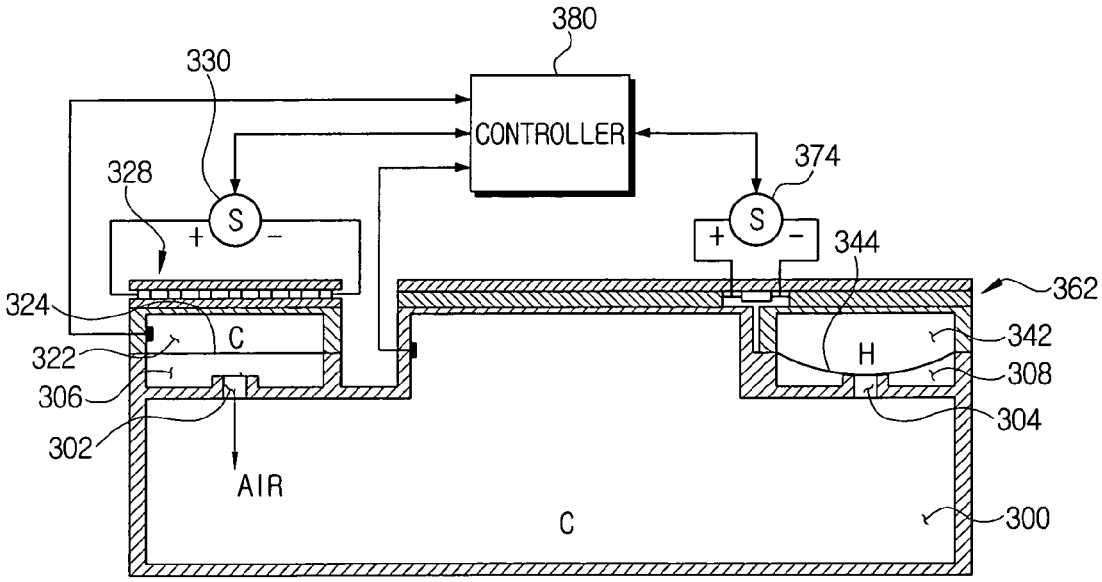
FIGS. 9A and 9B are cross-sectional views illustrating the operation of the micro pump shown in FIGS. 7 and 8.

Referring to FIG. 9A, a controller 380 controls power supplying units 330 and 374 to supply current to a first valve (vertical type) thermoelectric module 328 and the horizontal type thermoelectric module 362. Initially, both the first valve chamber 322 and the pump chamber 300 are cooled C, while the second valve chamber 342 is heated H. Thus, a thin film 324 of the first valve chamber 322 is contracted so as to open an inflow passage 302, while a thin film 344 of the second valve chamber 342 is expanded so as to close an outflow passage 304, and air in the pump chamber 300 is condensed so as to lower the pressure of the pump chamber 300. As a result, air passes through a first channel 306 and the inflow passage 302 so as to flow into the pump chamber 300.

Figure 9B:
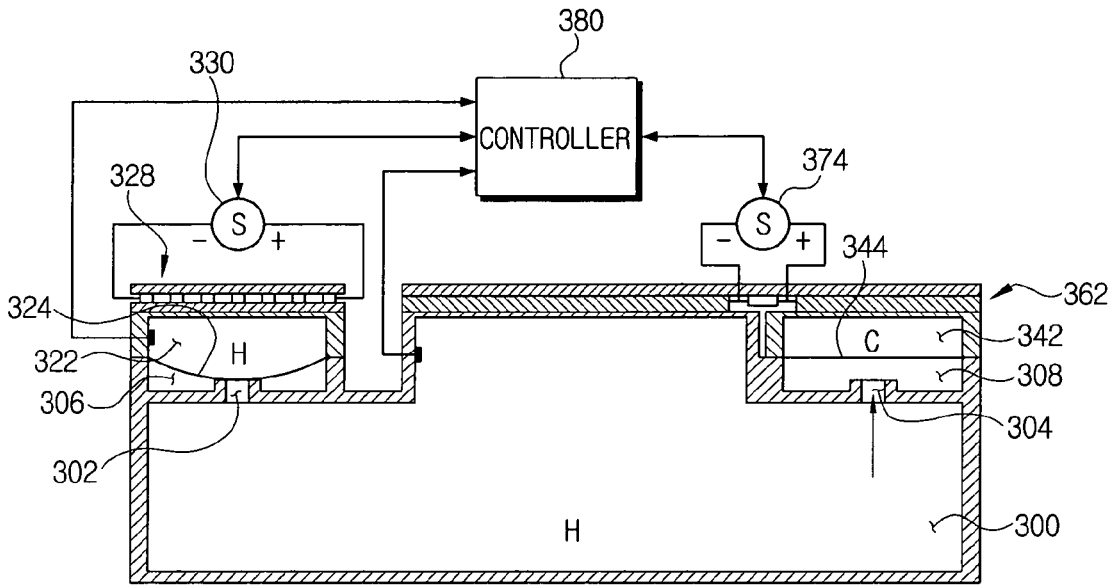

Referring to FIG. 9B, when the process of flowing air into pump chamber 300 is completed, the controller 380 changes directions of currents supplied to the thermoelectric modules 328 and 362. Thus, the first valve chamber 322 and the pump chamber 300 are now heated H, while the second valve chamber 342 is cooled C. As a result, the thin film 324 of the first valve chamber 322 is expanded to close the inflow passage 302, and the thin film 344 of the second valve chamber 342 is contracted to open the outflow passage 304. Air in the pump chamber 300 is expanded, and the pressure of the pump chamber 300 thus rises. As the pressure of the pump chamber 300 rises, the air in the pump chamber 300 flows out to a second channel 308 through the open outflow passage 304. The outflowing air allows a working fluid to be displaced and flow to a location utilizing the same.

As described above, since the thermoelectric module 362 of horizontal type heats or cools the pump chamber 300 and the second valve chamber 342, the structure of the micro pump becomes simpler. In addition, since a thermoelectric module of a horizontal type (using the heating or cooling energy of both sides thereof) is used instead of a thermoelectric module of a vertical type (using the heating or cooling energy of only side thereof), the energy consumption thereof is reduced.

Figure 10:
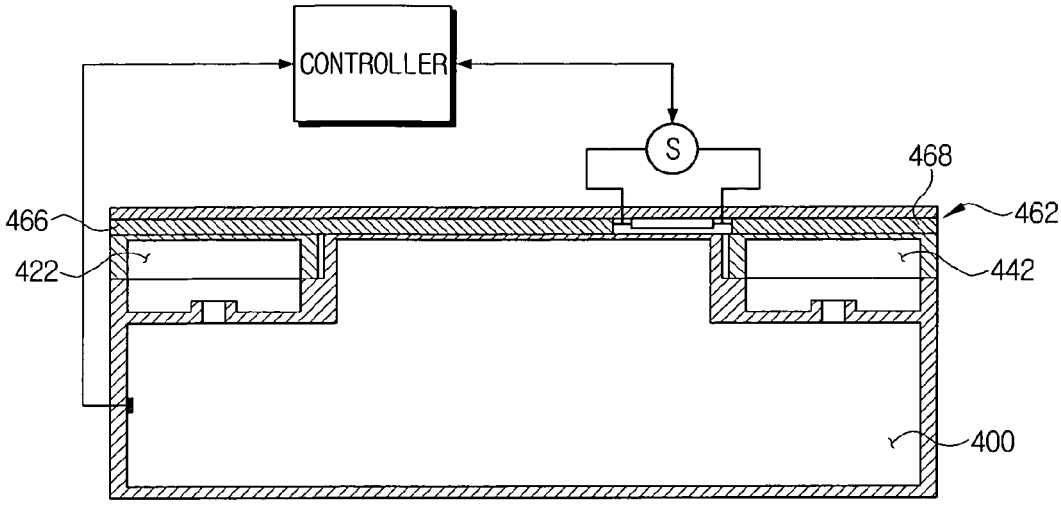
FIG. 10 is a schematic cross-sectional view of a micro pump according to yet another embodiment of the present invention.

FIG. 10 is a cross-sectional view of a micro pump according to yet another embodiment of the present invention.

Referring to FIG. 10, the micro pump according to the present embodiment is different from the micro pump according to the previous embodiment in that a horizontal type thermoelectric module 462 is used to heat or cool first and second valve chambers 422 and 442 and a pump chamber 400. A first plate 466 is attached to an upper surface of the first valve chamber 422, as well as to an upper surface of the pump chamber 400, and a second plate 468 is attached to an upper surface of the second valve chamber 442. The remaining elements of the micro pump according to the present embodiment are the same as those of the micro pump according to the previous embodiment, and thus their detailed description will be omitted.

The operation of the micro pump shown in FIG. 10 will be described with reference to FIGS. 11A and 11B.

Figure 11A:
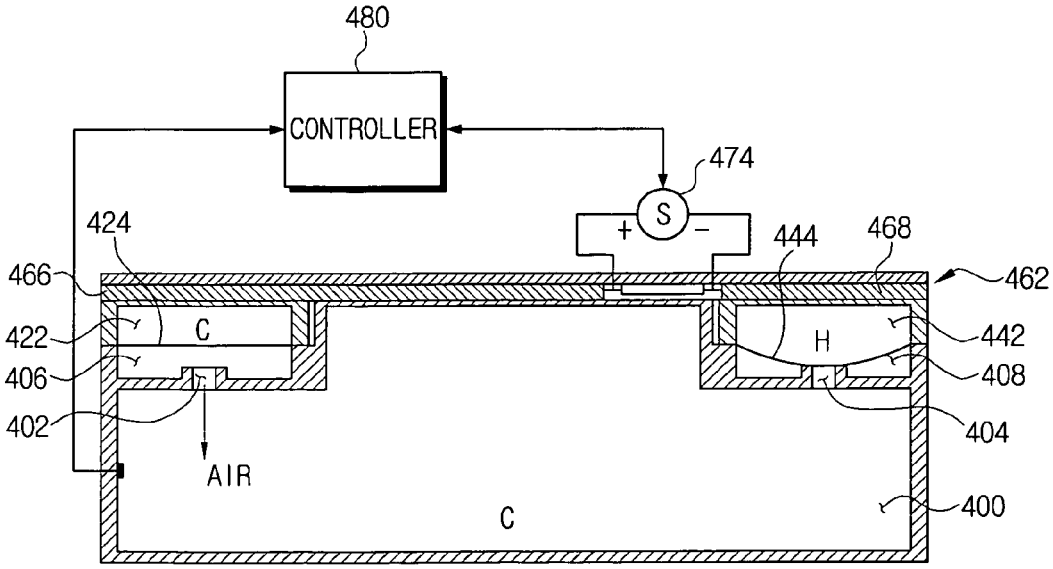
FIGS. 11A and 11B are cross-sectional views illustrating the operation of the micro pump shown in FIG. 10.

Referring to FIG. 11A, a controller 480 controls a power supplying unit 474 to supply current to the thermoelectric module 462. The first plate 466 is then cooled so as to cool both the first valve chamber 422 and the pump chamber 400. A thin film 424 of the first valve chamber 422 is contracted to open an inflow passage 402, while air in the pump chamber 400 is cooled C and condensed. Thus, the pressure of the pump chamber 400 drops below the atmospheric pressure. Air then flows into the pump chamber 400 through a first channel 406 due to the difference between the atmospheric pressure and the pressure of the pump chamber 400. Additionally, the second plate 468 heats the second valve chamber 442 to expand a thin film 444, which then closes an outflow passage 404.

Figure 11B:
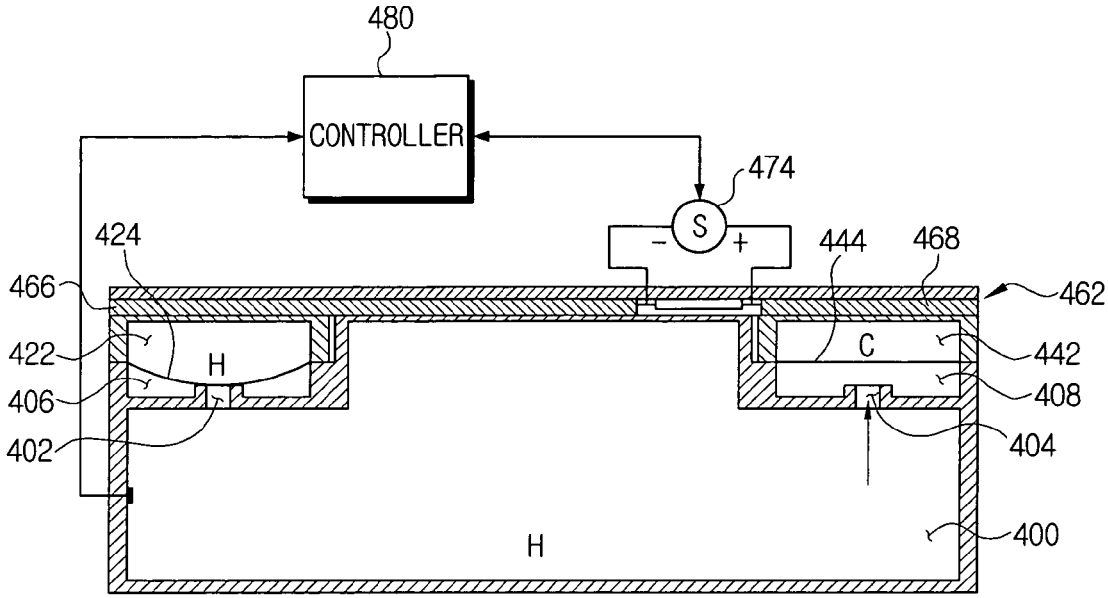

Referring to FIG. 11B, when the controller 480 changes the direction of the current supplied to the thermoelectric module 462, the first plate 466 is then heated while the second plate 468 is cooled. Correspondingly, the first valve chamber 422 and the pump chamber 400 are heated H, and the second valve chamber 442 is cooled C. As a result, the thin film 424 of the first valve chamber 422 is expanded so as to close the inflow passage 402. On the other hand, the thin film 444 of the second valve chamber 442 is contracted so as to open the outflow passage 404. Also, since the air in the pump chamber 400 is expanded, the pressure of the pump chamber 400 rises, eventually to a level above atmospheric pressure. At this point, the air in the pump chamber 400 flows out to a second channel 408 through the open outflow passage 404. The outflowing air moves a working fluid to a location utilizing the same. As described above, the thermoelectric module 462 is used to heat or cool the first and second valve chambers 422 and 442 and the pump chamber 400. Thus, unnecessary energy consumption can be reduced, and the structure of the micro pump can become simpler.

As described above, in a micro pump according to an embodiment of the present invention, a pumping operation may be repeatedly performed. Also, the structure of the micro pump can be simpler. As a result, a subminiature fluid system can be easily adopted to the micro pump.

In addition, the degree of opening and closing of the inflow and outflow passages can be regulated. Moreover, the degree of heating a drive fluid of the pump chamber can also be controlled. This in turn allows a minute flow amount of a working fluid to be controlled. As a result, a more precise fluid system can be embodied.

Furthermore, a thermoelectric module can be used to rapidly control the condensation and an expansion of air in the pump chamber. Thus, the response time of the micro pump can be improved with respect to conventional designs.

Also, because a horizontal type thermoelectric module can be used to open and/or close a valve and provide a driving force for the pumping working of the pump chamber, the structure of the pump chamber can be simpler. In addition, heated or cooled heat can be re-used, resulting in the reduction of energy consumption.

An air pressure can be used as the drive fluid. Thus, a higher pressure can be generated to flow the working fluid.

The foregoing embodiment and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A micro pump comprising:

a pump chamber comprising inflow and outflow passages through which a drive fluid flows;

a first valve chamber to which a vertical type Peltier device is directly attached, and the first valve chamber is selectively contracted or expanded so as to open or close the inflow passage;

a second valve chamber selectively contracted or expanded so as to open or close the outflow passage; and a horizontal type thermoelectric module configured to selectively directly heat and cool the pump chamber and the second valve chamber, wherein the inflow passage is disposed between the pump chamber and the first valve chamber, the outflow passage is disposed between the pump chamber and the second valve chamber, the pump chamber forms an undivided expanding and condensing space between the inflow passage and the outflow passage, and the horizontal type thermoelectric module comprises:

a first plate attached directly to the pump chamber;

a second plate attached directly to the second valve chamber; and a plurality of semiconductors interposed between the first and second plates and electrically connected to one another.

2. A micro pump comprising:

a pump chamber comprising inflow and outflow passages through which a drive fluid flows;

a first valve chamber configured to selectively open or close the inflow passage, the inflow passage being located between the pump chamber and the first valve chamber;

a second valve chamber configured to selectively open or close the outflow passage, the outflow passage being located between the pump chamber and the second valve chamber; and a horizontal type thermoelectric module configured to selectively directly heat and cool the pump chamber and the first and second valve chambers, wherein the horizontal type thermoelectric module comprises:

a first plate attached directly to the pump chamber and the first valve chamber;

a second plate attached directly to only the second valve chamber; and a plurality of semiconductors interposed between the first and second plates and electrically connected to one another, and the pump chamber forms an undivided expanding and condensing space between the inflow passage and the outflow passage.

3. The micro pump of claim 2, wherein a side of the first valve chamber facing the inflow passage is formed of a contractible and expandable thin film.

4. The micro pump of claim 2, wherein a side of the second valve chamber facing the outflow passage is formed of a contractible and expandable thin film.

* * * * *